US010281245B2

(12) United States Patent
DeKort

(10) Patent No.: US 10,281,245 B2
(45) Date of Patent: May 7, 2019

(54) BALLISTIC BARRIER

(71) Applicant: Michael Jacques DeKort, Allison Park, PA (US)

(72) Inventor: Michael Jacques DeKort, Allison Park, PA (US)

( * ) Notice: Subject to any disclaimer, the term of this patent is extended or adjusted under 35 U.S.C. 154(b) by 0 days.

(21) Appl. No.: 15/703,259

(22) Filed: Sep. 13, 2017

(65) Prior Publication Data

US 2018/0073841 A1 Mar. 15, 2018

Related U.S. Application Data

(60) Provisional application No. 62/394,943, filed on Sep. 15, 2016.

(51) Int. Cl.
*F41H 5/08* (2006.01)

(52) U.S. Cl.
CPC ..... *F41H 5/08* (2013.01)

(58) Field of Classification Search
CPC ..... F41H 5/06; F41H 5/08; F41H 5/24
USPC ..... 89/36.01, 36.04, 36.05, 36.07
See application file for complete search history.

(56) References Cited

U.S. PATENT DOCUMENTS 2,370,596 A * 2/1945 Wallace ..... F41H 5/08 109/49.5
3,745,938 A * 7/1973 Hathaway ..... F41H 5/08 109/49.5
6,807,890 B1 * 10/2004 Fuqua ..... F41H 5/08 89/36.02
7,124,675 B1 10/2006 Sand
7,424,844 B2 9/2008 Carter
8,671,820 B1 * 3/2014 Keyfauver ..... F41H 5/08 89/36.05
2003/0221256 A1 * 12/2003 Monk ..... A47B 95/02 5/420
2010/0083820 A1 4/2010 Doyner et al.
2010/0326001 A1 * 12/2010 Herron ..... E04B 2/12 52/576
2012/0006453 A1 1/2012 Clayton
2014/0233235 A1 8/2014 Micarelli
2017/0167826 A1 * 6/2017 Spransy ..... F41C 27/04

FOREIGN PATENT DOCUMENTS

WO 2010042617 A1 4/2010

* cited by examiner

*Primary Examiner* — Samir Abdosh
(74) *Attorney, Agent, or Firm* — Dunlap Bennett & Ludwig PLLC

(57) ABSTRACT

A ballistic barrier formed of adjoining panels. The panels are made of a bullet resistant material capable of absorbing an impact from a firearm. Each of the panels include a top edge, a bottom edge opposite the top edge, a first side edge, a second side edge opposite the first side edge, a front surface, and a rear surface opposite the front surface. The plurality of panels may include at least a first panel and a second panel. At least one male hinge portion is coupled to the first panel at the first side edge and at least one female hinge portion is coupled to the second panel at the second side edge. The male hinge portion is releasably secured to the female hinge portion pivotably connecting the first panel to the second panel and forming the ballistic barrier.

9 Claims, 4 Drawing Sheets

BALLISTIC BARRIER

CROSS-REFERENCE TO RELATED APPLICATION

This application claims the benefit of priority of U.S. provisional application No. 62/394,943, filed Sep. 15, 2016, the contents of which are herein incorporated by reference.

BACKGROUND OF THE INVENTION

The present invention relates to ballistic barriers and, more particularly, to a plurality of ballistic shields that join together to form a ballistic barrier.

Ballistic shields are shields designed to stop or deflect bullets fired at their carrier. Although modern ballistic shields are specifically designed to protect against handgun, long gun, and shotgun projectile threats, many will additionally protect against most types of stabbing or cutting-type weaponry, and hand-thrown or launched projectiles such as rocks and arrows. The most capable of hand-carried ballistic shields will reliably defeat high-velocity centerfire rifle calibers at muzzle velocities. Recent advances in material science have resulted in more efficient bullet protective composites and ceramic ballistic shield products.

Many modern hand-carried ballistic shields provide clear armored viewing visors, lighting systems, kickstands, carrying straps, and other features or options. Other designs are more basic and provide only a simple armor panel bolted onto a handle.

Currently, ballistic shields cannot protect users that are lying down and in a kneeling or crouched position.

As can be seen, there is a need for improved ballistic shields that protect users that are lying down and in a kneeling or crouched position.

SUMMARY OF THE INVENTION

In one aspect of the present invention, a ballistic barrier comprises: a plurality of panels made of a bullet resistant material capable of absorbing an impact from a firearm, wherein each of the plurality of panels comprises: a top edge; a bottom edge opposite the top edge; a first side edge; a second side edge opposite the first side edge; a front surface; and a rear surface opposite the front surface, wherein the plurality of panels comprise at least a first panel and a second panel, at least one male hinge portion is coupled to the first panel at the first side edge and at least one female hinge portion is coupled to the second panel at the second side edge, and the first male hinge portion is releasably secured to the first female hinge portion pivotably connecting the first panel to the second panel.

These and other features, aspects and advantages of the present invention will become better understood with reference to the following drawings, description and claims.

DETAILED DESCRIPTION OF THE INVENTION

Figure 1:
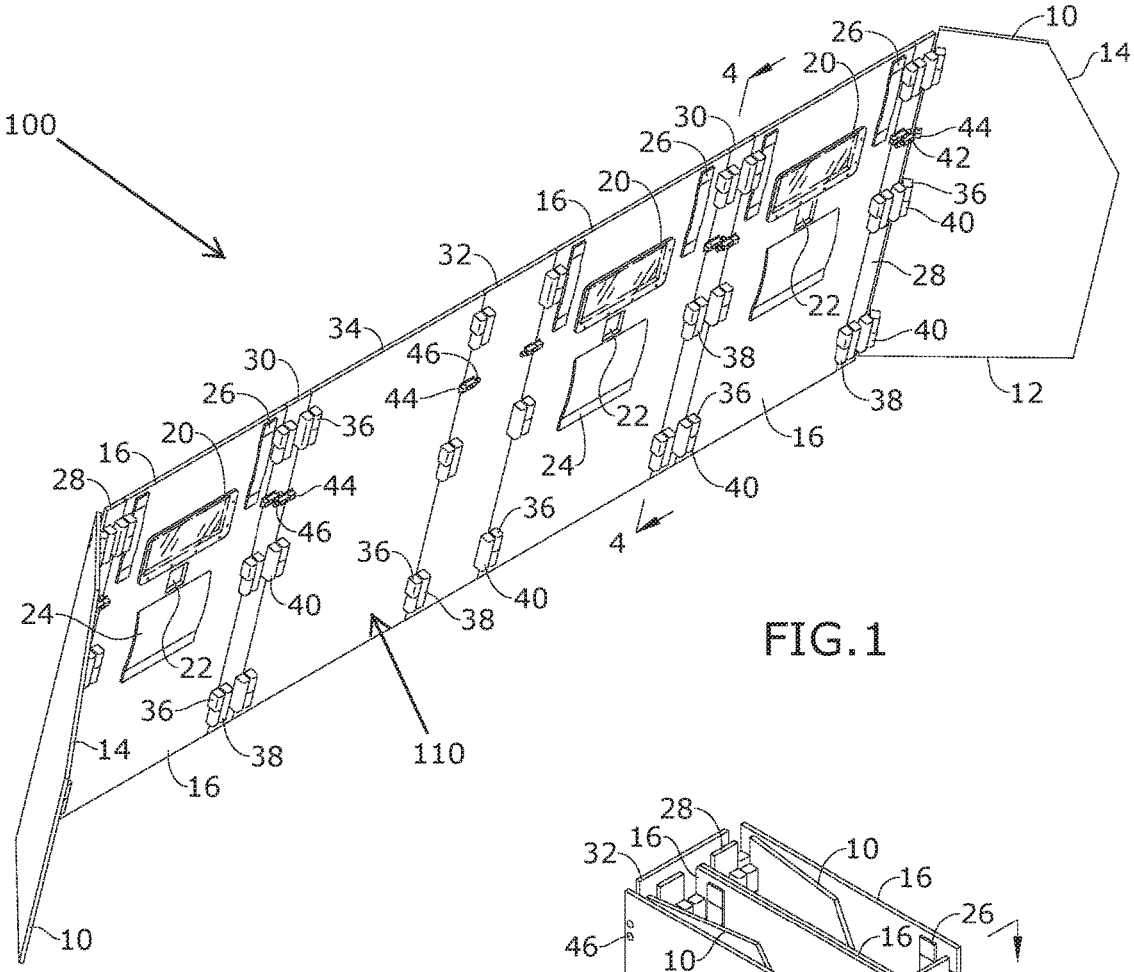
FIG. 1 is a perspective view of an embodiment of the present invention, illustrating an open and inclined configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention is modular and configurable horizontal portable ballistic barrier that utilizes a variable quantity and composition of solid ballistic panels or ballistic shields. The modular assembly can be configured to be any combination of shields and panels, used separately from one another or combined to form the barrier. The panels are hinged together permitting the modular configuration and allowing the barrier to fold for easy transportation, storage and deployment. Further, the adjoined panels may be picked up, moved and used as portable barrier. The components mentioned below can vary in size, shape, orientation and physical construction.

Referring to FIGS. 1 through 7, the present invention includes a ballistic barrier 100 formed of adjoining panels 110. The panels 110 are made of a bullet resistant material capable of absorbing an impact from a firearm. Each of the panels 110 include a top edge, a bottom edge opposite the top edge, a first side edge, a second side edge opposite the first side edge, a front surface, and a rear surface opposite the front surface. The plurality of panels 110 may include at least a first panel and a second panel. At least one male hinge portion 36 is coupled to the first panel at the first side edge and at least one female hinge portion 40 is coupled to the second panel at the second side edge. The male hinge portion 36 is releasably secured to the female hinge portion 40 pivotably connecting the first panel to the second panel and forming the ballistic barrier 100.

The panels 110 of the present invention are shields designed to stop or deflect bullets fired at their carrier. The bullet resistant material may include, but is not limited to, polyethylene, aramid, graphene, metal (steel, brass and the like), ceramic or a combination thereof. The panels 110 may be rectangular shape with a substantially flat, planar front surface and rear surface with the side edges pivotably adjoined to one another. Due to the adjoining panels 110, the present invention forms an elongated ballistic barrier 100 capable of protecting multiple users while they are standing, sitting, crouching, or laying prone. The panels 110 may further accommodate attachments, such as wheels or stands.

Figure 2:
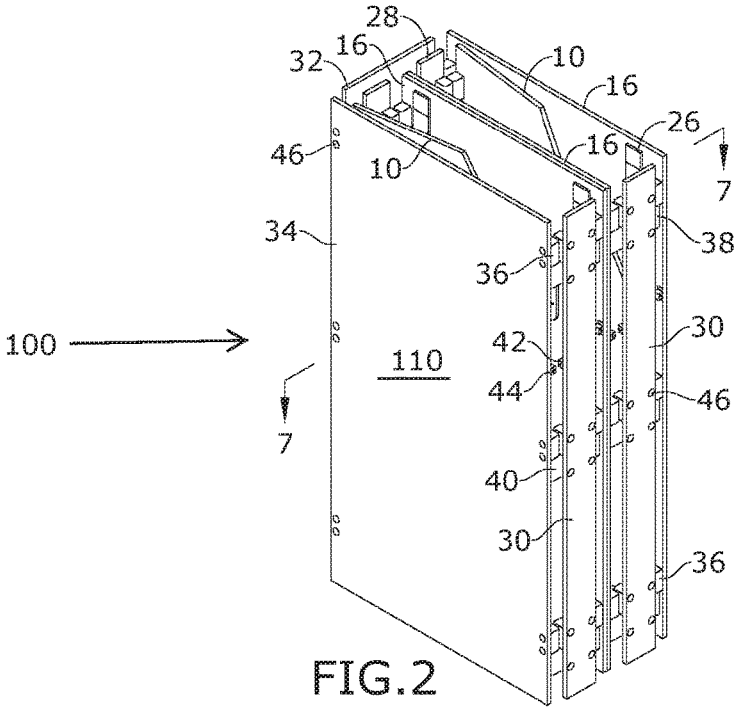
FIG. 2 is a perspective view of an embodiment of the present invention, illustrating a folded configuration.
Figure 3:
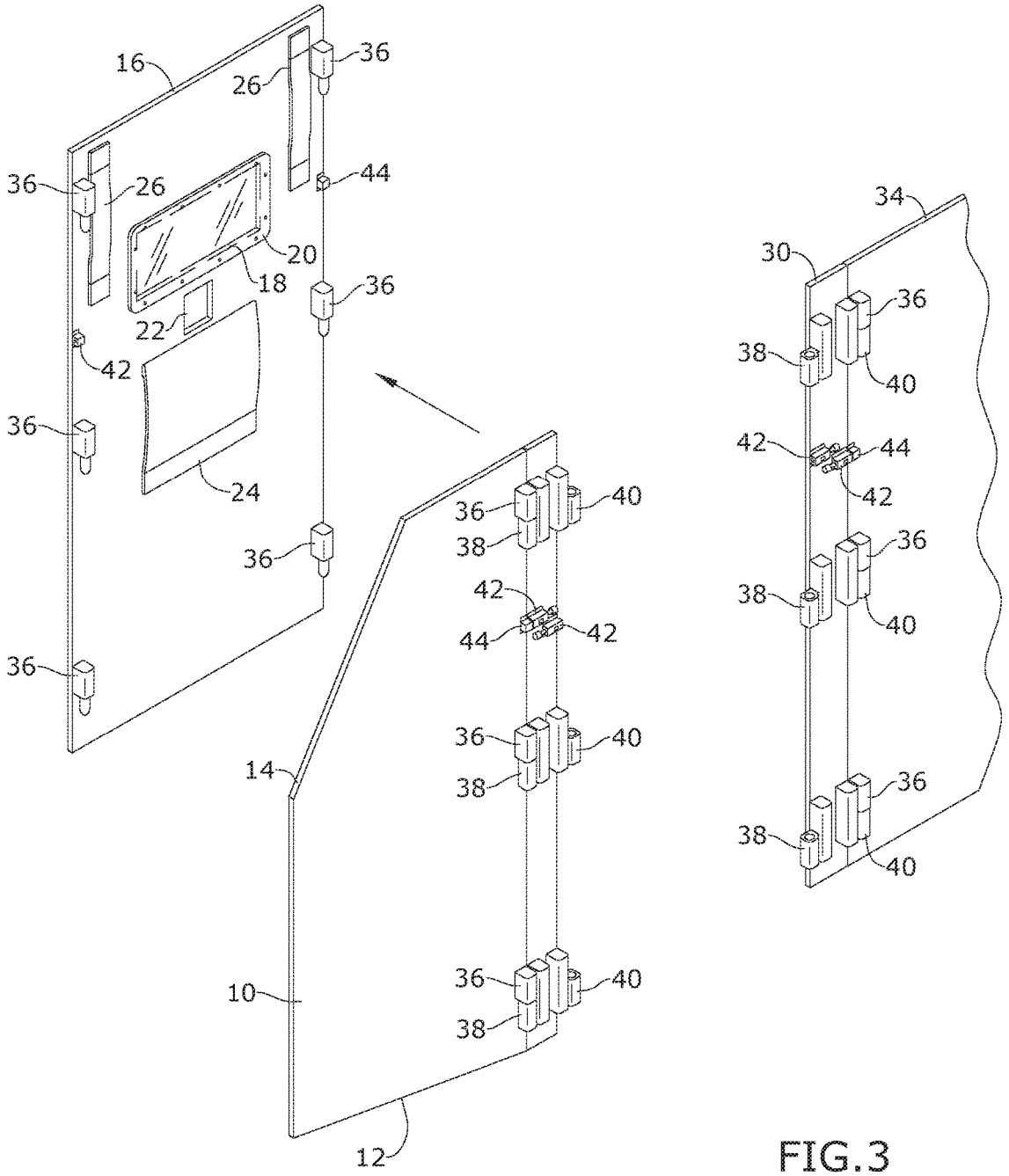
FIG. 3 is a perspective view of an embodiment of the present invention, illustrating the removal of a single shield.
Figure 4:
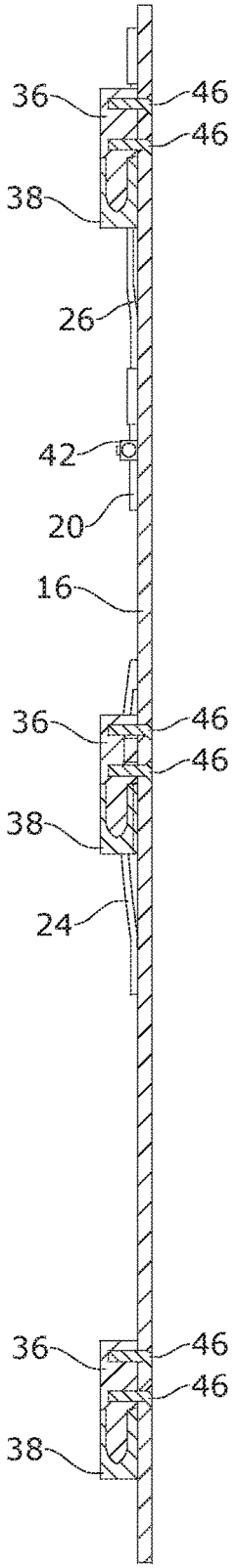
FIG. 4 is a section view of the present invention, taken along line 4-4 in FIG. 1.
Figure 5:
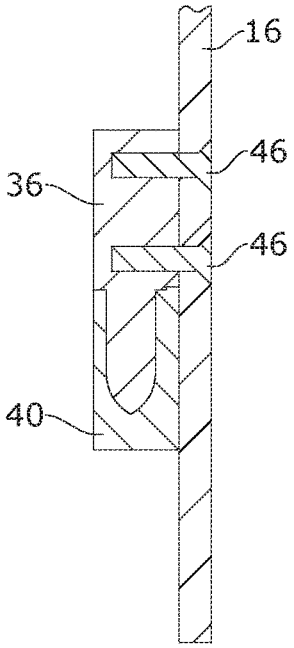
FIG. 5 is a detail section view of an embodiment of the present invention.
Figure 6:
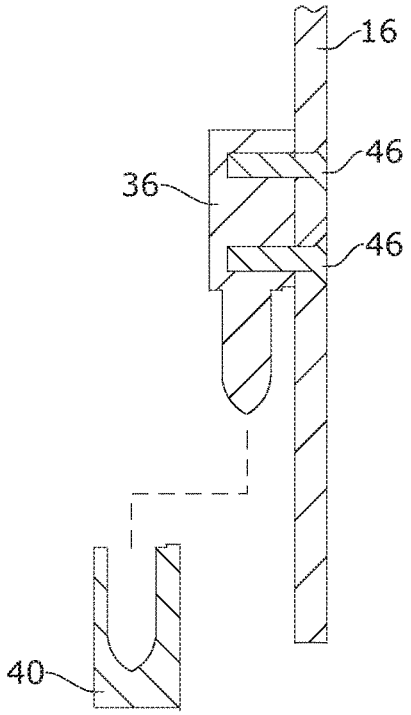
FIG. 6 is a detail section view of an embodiment of the present invention, illustrating a disconnection between two panels.
Figure 7:
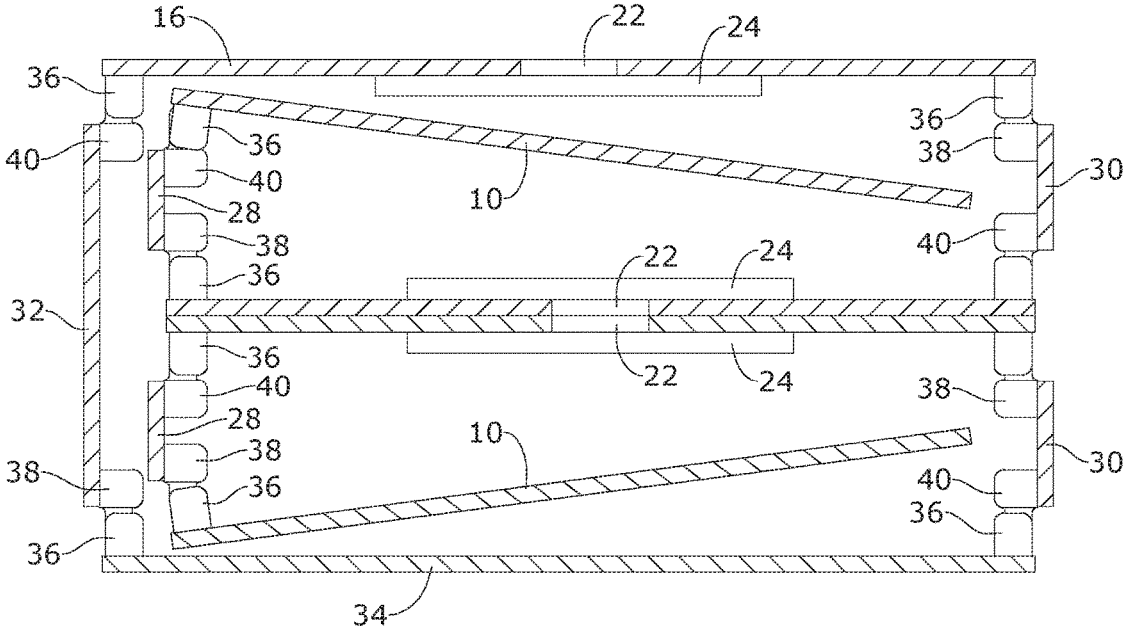
FIG. 7 is a section view of the present invention taken along line 7-7 in FIG. 2.

In certain embodiments, the protective barrier 100 may be formed of multiple panels 110 including two end panels 10, a pair of outer connector panels 28, a pair of inner connector panels 30, a center connector panel 32, shield panels 16 and a solid panel 34. The end panels 10 may be connected to the shield panels 16 by the outer connector panels 28. An outer shield panel 16 may be connected to the solid panel 34 by one of the inner connector panels 30 and another outer shield panel 16 may be connected to an inner shield panel 16 by the other of the inner connector panels 30. The inner shield panel 16 and the solid panel 34 may both be connected to the center connector panel 32. The solid panel 34 and the shield panels 26 may include a greater width from side to side than the connector panels. As illustrated in FIG. 1, the present invention may be in an unfolded and deployed position. As illustrated in FIG. 2, the panels 110 pivot about the hinges into a folded and stowed position.

The two end panels 10 form the ends of the protective barrier 100. Each of the end panels 10 include inner side edges. Three of the male hinge portions 36 may be secured to the each of the end panels 10 by hinge screws 46 at the inner side edges. In certain embodiments, outers corners 14 of the two end panels 10 may be cut off to provide clearance. The two end panels 10 may be disposed at an angle relative to the rest of the panels 110 in the deployed position so that the lower edges 12 of the end panels 10 may support the protective barrier 100 in an upright position.

The shield panels 16 make up a central portion of the protective barrier 100 and may further be detached from the protective barrier 100 and used as individual shields. Each of the plurality of shield panels 16 may include three male hinge portions 36 coupled at the first side edge and three male hinge portions 36 coupled at the second side edge. The shield panels 16 may further include a viewing port 18 and a gun port 22 formed through the front surface and the rear surface of the panel 110. A viewing port cover 20 made of a transparent material may be coupled to the inner surface of the panel 110 and covers the viewing port 18. Each of the plurality of shield panels 16 may further include carrying straps, such as an arm strap 24 and hand straps 26. The carrying straps may each include a first end opposite a second end. The first end and second end are coupled to the inner surface forming a loop in between the straps and the inner surface of the shied panel 16. The straps may be made of a nylon or other fibrous material.

The solid panel 34 also makes up a central portion of the protective barrier 100. The solid panel 34 may include three male hinge portions 36 coupled at the first side edge and three male hinge portions 36 coupled at the second side edge. The solid panel 34 is similar in size and shape with the shield panels 16. However, the solid panels 34 may not include the viewing port 18, the gun port 22 and the carrying straps. The solid panel 34 may be used as a fully protected area behind the ballistic barrier 100.

As mentioned above, the connector panels of the present invention may include a pair of outer connector panels 28, a pair of inner connector panels 30, and a center connector panel 32. The center connector panel 32 may have a greater width than the outer and inner connector panels 28, 30. Each of the connector panels may include three female hinge portions 40 coupled at the first side edge and three female hinge portions 40 coupled at the second side edge. The connector panels connect the above mentioned end panels 10, shield panels 26 and solid panel 34 together and allow the above mentioned panels 110 to pivot relative to one another into a stowed and deployed position.

The panels 110 may include more or less than three hinge portions 36, 40. For example, the panels 110 may include one, two, four or more hinge portions 36, 40 on one or each of the sides. The male hinge portions 36 and the female hinge portions 40 may be coupled to the above mentioned panels 110 by hinge screws 46. The male hinge portions 36 and the female hinge portions 40 connect together to form a hinge. In certain embodiments, the male hinge portions 36 may include a peg. The female hinge portions 40 may include a slot. The peg aligns and inserts into the slot along a vertical axis. Therefore, the panels 110 may be lifted and lowered vertically relative to one another to connect and disconnect from one another other. The peg may be a cylindrical shape and the slot may define the cylindrical shape. Therefore, the peg may rotate freely within the slot, allowing the panels 110 to pivot relative to one another.

The panels 110 of the present invention may further include latches. The latches lock the panels 110 together preventing the panels 110 from pivoting relative to one another in a the deployed position. For example, at least one male latch portion 42 is coupled to the first panel 110 at the first side edge and at least one female latch portion 44 is coupled to the second panel 110 at the second side edge. The male latch portion 42 inserts into the female latch portion 44, locking the first panel 110 and the second panel 110 together preventing the first panel 110 and the second panel 110 from pivoting relative to one another. The male latch portion 42 may include a peg and the female latch portion 44 may include a slot. The peg aligns and inserts into the slot along a horizontal axis. Each of the above mentioned panels 110 may lock relative to their adjacent panels 110 using the latch.

It should be understood, of course, that the foregoing relates to exemplary embodiments of the invention and that modifications may be made without departing from the spirit and scope of the invention as set forth in the following claims.

What is claimed is:

1. A ballistic barrier comprising:

a plurality of panels made of a bullet resistant material capable of absorbing an impact from a firearm, wherein each of the plurality of panels comprises:
- a top edge;
- a bottom edge opposite the top edge;
- a first side edge;
- a second side edge opposite the first side edge;
- a front surface; and
- a rear surface opposite the front surface, wherein the plurality of panels comprise at least a first panel and a second panel, at least one male hinge portion is coupled to the first panel at the first side edge and at least one female hinge portion is coupled to the second panel at the second side edge, the first male hinge portion is releasably secured to the first female hinge portion pivotably connecting the first panel to the second panel, the plurality of panels comprise at least one connector panel and a plurality of shield panels comprising at least a first shield panel and a second shield panel, the at least one connector panel comprises at least one first female hinge portion coupled at the first side edge and at least one second female hinge portion coupled at the second side edge, each of the plurality of shield panels comprise at least one first male hinge portion coupled at the first side edge and at least one second male hinge portion coupled at the second side edge, the at least one first female hinge portion is releasably secured to the at least one first male hinge portion of the first shield panel and the at least one second female hinge portion is releasably secured to the at least one second male hinge portion of the second shield panel, a width of each of the plurality of shield panels is substantially greater than a width of the at least one connector panel, and each of the plurality of shield panels comprises a viewing port formed through the front surface and the rear surface.

2. The ballistic barrier of claim 1, wherein the front surface and the rear surface are each substantially planar.

3. The ballistic barrier of claim 1, wherein the bullet resistant material is polyethylene, aramid, graphene, metal, ceramic or a combination thereof.

4. The ballistic barrier of claim 1, wherein each of the plurality of shield panels comprises a viewport cover made of a transparent material coupled to the inner surface and covering the viewing port.

5. The ballistic barrier of claim 1, wherein each of the plurality of shield panels comprise a carrying strap comprising a first end opposite a second end, wherein the first end and second end are coupled to the inner surface forming a loop in between.

6. The ballistic barrier of claim 1, wherein the at least one male hinge portion comprises a peg and the at least one female hinge portion comprises a slot, wherein the peg aligns and inserts into the slot along a vertical axis.

7. The ballistic barrier of claim 1, further comprising at least one male latch portion coupled to the first panel at the first side edge and at least one female latch portion coupled to the second panel at the second side edge, wherein the at least one male latch inserts into the at least one female latch, locking the first panel and the second panel together preventing the first panel and the second panel from pivoting relative to one another.

8. The ballistic barrier of claim 7, wherein the at least one male latch portion comprises a peg and the at least one female latch portion comprises a slot, wherein the peg aligns and inserts into the slot along a horizontal axis.

9. A ballistic barrier comprising:

a plurality of panels made of a bullet resistant material capable of absorbing an impact from a firearm, wherein each of the plurality of panels comprises:

a top edge;

a bottom edge opposite the top edge;

a first side edge;

a second side edge opposite the first side edge;

a front surface; and a rear surface opposite the front surface, wherein the plurality of panels comprise at least a first panel and a second panel, at least one male hinge portion is coupled to the first panel at the first side edge and at least one female hinge portion is coupled to the second panel at the second side edge, the first male hinge portion is releasably secured to the first female hinge portion pivotably connecting the first panel to the second panel, the plurality of panels comprise at least one connector panel and a plurality of shield panels comprising at least a first shield panel and a second shield panel, the at least one connector panel comprises at least one first female hinge portion coupled at the first side edge and at least one second female hinge portion coupled at the second side edge, each of the plurality of shield panels comprise at least one first male hinge portion coupled at the first side edge and at least one second male hinge portion coupled at the second side edge, the at one first female hinge portion is releasably secured to the at least one first male hinge portion of the first shield panel and the at least one second female hinge portion is releasably secured to the at least one second male hinge portion of the second shield panel, a width of each of the plurality of shield panels is substantially greater than a width of the at least one connector panel, and each of the plurality of shield panels comprise a carrying strap comprising a first end opposite a second end, wherein the first end and second end are coupled to the inner surface forming a loop in between.

* * * * *